US010286664B2

(12) United States Patent
Terasaki et al.

(10) Patent No.: US 10,286,664 B2
(45) Date of Patent: May 14, 2019

(54) LIQUID EJECTION HEAD, METHOD FOR MANUFACTURING THE SAME, AND PRINTING METHOD

(71) Applicant: CANON KABUSHIKI KAISHA, Tokyo (JP)

(72) Inventors: Atsunori Terasaki, Kawasaki (JP); Yoshiyuki Fukumoto, Kawasaki (JP); Masaya Uyama, Kawasaki (JP); Takeru Yasuda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/600,543

(22) Filed: May 19, 2017

(65) Prior Publication Data

US 2017/0341389 A1 Nov. 30, 2017

(30) Foreign Application Priority Data

May 26, 2016 (JP) ..... 2016-105149
Feb. 24, 2017 (JP) ..... 2017-033306

(51) Int. Cl.
*B41J 2/14* (2006.01)
*B41J 2/16* (2006.01)

(52) U.S. Cl.
CPC ..... *B41J 2/1433* (2013.01); *B41J 2/14145* (2013.01); *B41J 2/162* (2013.01); *B41J 2/164* (2013.01); *B41J 2/1606* (2013.01); *B41J 2/1623* (2013.01); *B41J 2/1642* (2013.01); *B41J 2/1646* (2013.01)

(58) Field of Classification Search
CPC ..... B41J 2/1433; B41J 2/1646; B41J 2/1642; B41J 2/14145; B41J 2/1606; B41J 2/162; B41J 2/164; B41J 2/1623
See application file for complete search history.

(56) References Cited

U.S. PATENT DOCUMENTS

| | | | | |
|---|---|---|---|---|
| 2002/0158945 | A1 | 10/2002 | Miller | |
| 2009/0152236 | A1 | 6/2009 | Ikeda | |
| 2013/0314474 | A1* | 11/2013 | Yasuda | B41J 2/14129 347/61 |
| 2014/0184705 | A1 | 7/2014 | Wakamatsu | |
| 2014/0267497 | A1 | 9/2014 | Takagi | |
| 2017/0341390 | A1* | 11/2017 | Kanri | B41J 2/162 |

FOREIGN PATENT DOCUMENTS

| | | | |
|---|---|---|---|
| CN | 1729041 | A | 2/2006 |
| CN | 103419493 | A | 12/2013 |
| JP | 2002-347247 | A | 12/2002 |
| JP | 2004-74809 | A | 3/2004 |
| JP | 2006-227544 | A | 8/2006 |
| JP | 2008-030309 | A | 2/2008 |
| JP | 2012-213967 | A | 11/2012 |

* cited by examiner

*Primary Examiner* — Henok D Legesse
(74) *Attorney, Agent, or Firm* — Canon USA, Inc., IP Division

(57) ABSTRACT

A liquid election head including a silicon substrate and an element for generating energy that is utilized for electing a liquid on the silicon substrate, wherein a protective layer A containing a metal oxide is disposed on a first surface of the silicon substrate, a structure containing an organic resin and constituting part of a liquid flow passage is disposed on the protective layer A, and an intermediate layer A containing a silicon compound is disposed between the protective layer A and the structure.

19 Claims, 13 Drawing Sheets

FIG. 4A
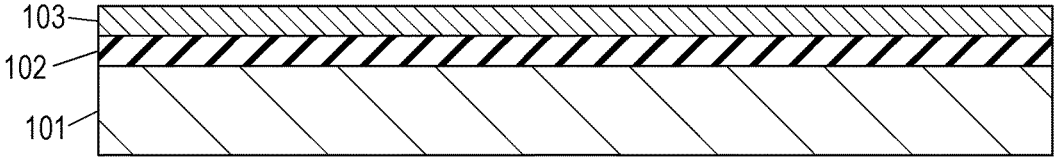
FIG. 4B
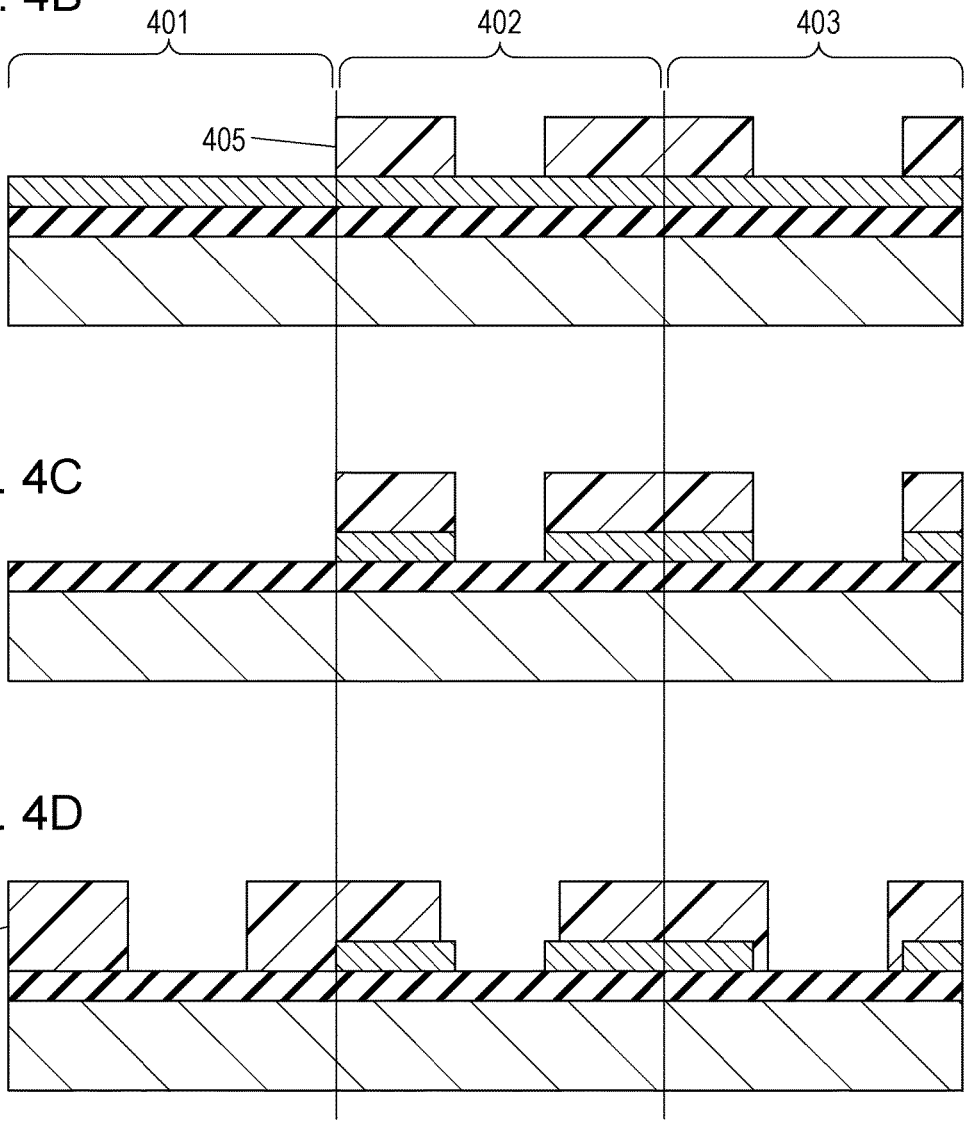
FIG. 4C
FIG. 4D

LIQUID EJECTION HEAD, METHOD FOR MANUFACTURING THE SAME, AND PRINTING METHOD

BACKGROUND OF THE INVENTION

Field of the Invention

The present disclosure relates to a liquid ejection head, a method for manufacturing the same, and a printing method.

Description of the Related Art

A liquid ejection head, for example, an ink-jet print head, includes a supply passage and a flow passage for passing a liquid, the passages formed in a substrate composed of silicon or the like. Usually, the supply passage and the flow passage are formed by forming a recess in the substrate and may be formed as through holes that penetrate the substrate. Structures, e.g., a flow passage forming member for forming the flow passage and an ejection port forming member for forming an ejection port, are disposed on the substrate, and the flow passage forming member may constitute the ejection port. Also, an energy generating element that generates energy for ejecting the liquid is disposed on the substrate, and the liquid is elected from the ejection port as a result of the energy being applied to the liquid. Regarding the method for manufacturing the structure, for example, Japanese Patent Laid-Open No. 2006-227544 describes a method for manufacturing a structure composed of an organic resin on a substrate by attaching a photosensitive resin film to a substrate that has fine recessed portions and performing exposure and development.

In the case where the supply passage and the flow passage are disposed in the silicon substrate, silicon exposed at inner walls of the supply passage and the flow passage may be dissolved depending on the type of the liquid, for example, ink, used and the condition of use. In particular, dissolution of silicon frequently occurs in the case where an alkaline ink is used as the liquid. Even when the amount of dissolution is very small, the ejection characteristics and resulting images may be affected by the dissolution of silicon into the liquid, and the flow passage structure itself may deform with long-term use. Consequently, silicon exposed at inner walls of the supply passage and the flow passage is protected. For example, Japanese Patent Laid-Open. No. 2002-347247 describes an example in which a protective layer containing an organic resin is formed on a surface to be brought into contact with a liquid. Also, Japanese Patent Laid-Open No. 2004-74809 describes an example in which an ink resistant thin film composed of titanium, a titanium compound, or alumina ($Al_2O_3$) is formed.

SUMMARY OF THE INVENTION

A liquid ejection head includes a silicon substrate and an element for generating energy that is utilized for ejecting a liquid on the silicon substrate, wherein a protective layer A containing a metal oxide is disposed on a first surface of the silicon substrate, a structure containing an organic resin and constituting part of a liquid flow passage is disposed on the protective layer A, and an intermediate layer A containing a silicon compound is disposed between the protective layer A and the structure.

A method for manufacturing the liquid ejection head includes the steps of forming a protective layer A containing a metal oxide on the first surface of a silicon substrate by an atomic layer deposition (ALD) method, forming an intermediate layer A containing a silicon compound on the protective layer A, and forming a structure containing an organic resin on the intermediate layer A.

A printing method includes the step of ejecting a liquid containing a pigment from the above-described liquid election head so as to perform printing.

Further features of the present disclosure will become apparent from the following description of exemplary embodiments with reference to the attached drawings.

BRIEF DESCRIPTION OF THE DRAWINGS

FIGS. 4A to 4D are sectional views showing the steps of producing the substrates according to examples and comparative examples.

DESCRIPTION OF THE EMBODIMENTS

Liquid Ejection Head

A liquid ejection head includes a silicon substrate and an element for generating energy that is utilized for ejecting a liquid (hereafter also referred to as energy generating element) on the silicon substrate, wherein a protective layer A containing a metal oxide is disposed on a first surface of the silicon substrate and a structure containing an organic resin is disposed on the protective layer A. In addition, the substrate includes an intermediate layer A that contains a silicon compound and is disposed between the protective layer A and the structure.

Figure 1A:
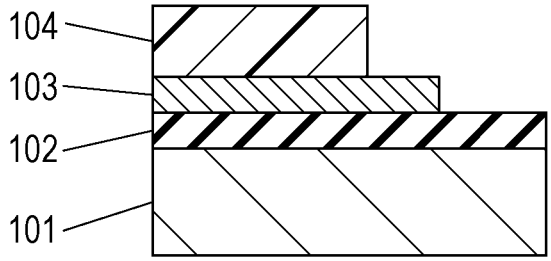
FIGS. 1A and 1B are sectional views showing an example of a substrate.
Figure 1B:
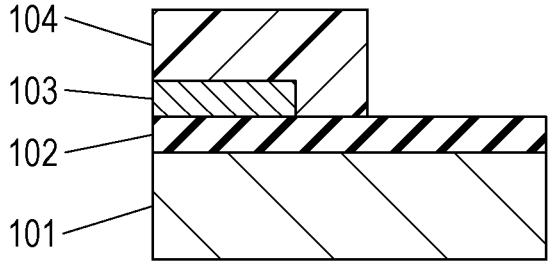

Examples of the substrates used for the liquid election head will be described with reference to FIGS. 1A and 1B. As shown in FIGS. 1A and 1B, a protective layer A 102 containing a metal oxide is disposed on a silicon substrate 101, an intermediate layer A 103 is disposed on the protective layer A 102, and a structure 104 containing an organic resin is disposed on the intermediate layer A 103. The intermediate layer A 103 may completely separate the protective layer A 102 from the structure 104 at the interface as shown in FIG. 1A or may partly separate the protective layer A 102 from the structure 104 at the interface as shown in FIG. 1B.

In many cases where exposed silicon is protected as described above, formation of the protective layer for preventing dissolution of silicon is performed prior to formation of the structure containing an organic resin. Therefore, there is an adhesion interface between the protective layer and the structure. A metal oxide film can be used as the protective layer from the viewpoint of preventing dissolution of silicon. However, if the metal oxide film is used as the protective layer, the adhesiveness between the structure and the protective layer may be degraded and interfacial peeling may occur with long-term dipping of the substrate into the liquid. It has been conjectured that subjecting the structure to long-term dipping into the liquid will alter the quality of the protective layer A 102 in accordance with the mechanism shown in FIGS. 9A to 9C, and as a result, interfacial peeling will occur.

Figure 9A:
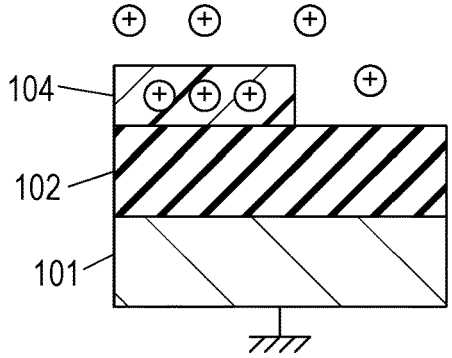
FIGS. 9A to 9C are sectional views illustrating an estimated mechanism of an occurrence of interfacial peeling.

Cations contained in the liquid and water permeate the structure 104 containing an organic resin (FIG. 9A). In the liquid, alkali metal ions, e.g., Na and K, and protons ionized in the water may be present as cations. In particular, in the case where a liquid containing a pigment is used as the liquid, large amounts of alkali metal ions, e.g., Na and K, derived from a resin used for dispersing the pigment may be contained. Regarding the permeation route, permeation from a pattern edge of the structure 104 at the interface to the protective layer A 102 and permeation inside the structure 104 are considered.

Figure 9B:
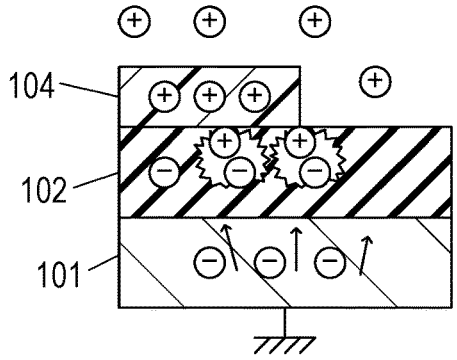

Meanwhile, electrons serving as carriers are supplied from the grounded silicon substrate 101 to the protective layer A 102. The protective layer A 102 contains a metal oxide and, therefore, has semiconductor characteristics in accordance with the film formation condition and the use condition. Consequently, electrons serving as carriers supplied from the silicon substrate 101 may flow within the protective layer A 102. Examples of metal oxides that tend to have semiconductor characteristics include titanium oxide, vanadium oxide, and zirconium oxide. Cations that permeate the structure 104 and electrons that are supplied from the silicon substrate 101 and flow within the protective layer A 102 recombine at the interface between the structure 104 and the protective layer A 102 and permeate the metal oxide, thereby causing alteration of the surface of the protective layer A 102 (FIG. 9B).

Figure 9C:
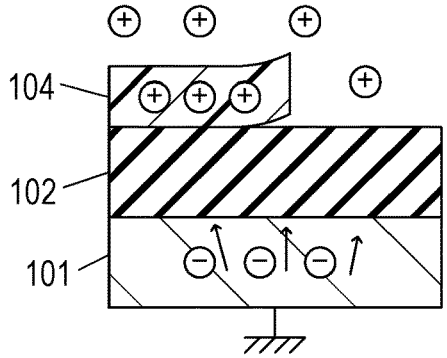

As a result, a change in the adhesiveness occurs between the surface of the protective layer A 102 and the structure 104, and interfacial peeling occurs (FIG. 9C). For example, in the case where a TiO film was used as the protective layer A 102, it was ascertained by analysis of the adhesion interface between the structure 104 and the protective layer A 102 that the quality of the TiO film was altered at the location at which peeling occurred. No alterations of portions not in contact with the structure 104 of the TiC film were observed. Therefore, it was estimated that contact between the structure 104 and the protective layer A 102 caused or facilitated interfacial peeling.

Figure 2A:
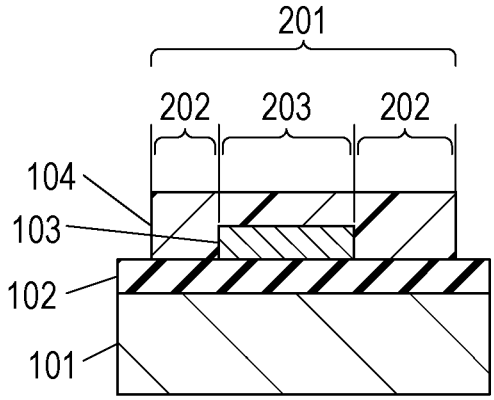
FIGS. 2A and 2B are sectional views showing an example of the substrate.
Figure 2B:
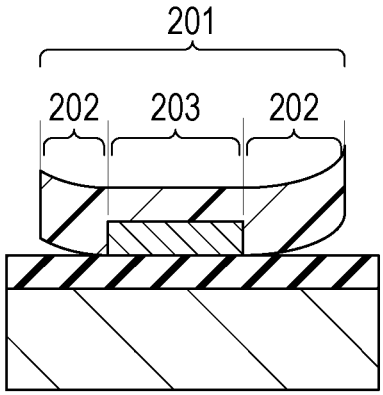

An intermediate layer A containing a silicon compound is interposed between the protective layer A and the structure. The intermediate layer A contains a silicon compound and, thereby, conduction of cations to the protective layer A is hindered, thus preventing the occurrence of interfacial peeling with long-term dipping into the liquid. It is not required that the intermediate layer A be in direct contact with the protective layer A and the structure as long as the intermediate layer A is interposed between the protective layer A and the structure. However, from the viewpoint of ensuring adhesiveness between the protective layer A and the structure, the protective layer A can be in direct contact with the structure. The above-described effect is also exerted in the case where the protective layer A 102 is partly in contact with the structure 104, as shown in FIG. 1B. For example, as shown in FIG. 2A, the region in which the structure 104 is disposed is specified as 201, the region in which the structure 104 is in direct contact with the protective layer A 102 is specified as 202, and the region in which the protective layer A 102 is separated from the structure 104 by the intermediate layer A 103 is specified as 203. In the case where the substrate shown in FIG. 2A is subjected to long-term dipping into the liquid, as shown in FIG. 2B, peeling advances in the region 202, but interfacial peeling fails to advance after peeling reaches the reckon. 203. Consequently, the adhesiveness of the entirety of the substrate is maintained.

The region 203 in which the intermediate layer A 103 is disposed may be freely designed as long as sufficient adhesion strength for satisfying the function of the device is maintained. The adhesion strength refers to the strength required for resisting mechanical peeling or the strength at which the liquid does not seep between the regions separated from each other by the structure 104. From such viewpoints, the proportion of the contact area between the structure and the intermediate layer A relative to the contact area between the structure and the protective layer A or the intermediate layer A when projected in a direction perpendicular to the first surface of the silicon substrate (hereafter also referred to as interface coverage of intermediate layer A) is preferably 50% or more. The above-described proportion is more preferably 80% or more, further preferably 90% or more, and particularly preferably 100%; that is, the intermediate layer A can be disposed across the entire interface between the protective layer A and the structure. In this regard, for example, in FIGS. 2A and 2B, the contact area between the structure 104 and the protective layer A 102 or the intermediate layer A 103 refers to the area of the region 201 when projected in a direction perpendicular to the first surface of the silicon substrate. The contact area between the structure 104 and the intermediate layer A 103 refers to the area of the region 203 when projected in a direction perpendicular to the first surface of the silicon substrate.

The protective layer A contains a metal oxide and has a function of preventing corrosion of the silicon substrate in the usage environment of the device. For example, in the liquid ejection head, dissolution of Si of the silicon substrate by the liquid to be elected is prevented. The metal element of the above-described metal oxide can be titanium, zirconium, hafnium, vanadium, niobium, or tantalum because of the high corrosion resistance of these oxides to alkali solutions. A suitable example of the protective layer A is a TiC film. The metal oxides may be used alone, or at least two may be used in combination. The content of the metal oxide in the protective layer A is preferably 80 percent by mass or more. The content is more preferably 90 percent by mass or more, and further preferably 100 percent by mass; that is, the protective layer A can be composed of the metal oxide. In the exposed surface of the silicon substrate, places that affect the device performance and reliability due to dissolution may be protected by the protective layer A. Regarding the substrate provided with the supply passage and the flow passage, the protective layer A can be disposed across the entire silicon substrate surface exposed. The method for forming the protective layer A may be appropriately selected from the film formation methods, e.g., a CVD method, a sputtering method, and an atomic layer deposition (ALD) method, in accordance with the structure of the silicon substrate surface exposed. However, from the viewpoint of good conformality, the protective layer A can be formed by the atomic layer deposition method. That is, the method for manufacturing a liquid election head can include the steps of forming the protective layer A containing a metal oxide on the first surface of the silicon substrate by the atomic layer deposition method, forming the intermediate layer A containing a silicon compound on the protective layer A, and forming the structure containing an organic resin on the intermediate layer A. There is no particular limitation regarding the thickness of the protective layer A and, for example, 5 to 500 nm may be used.

The intermediate layer A contains a silicon compound from the viewpoint of hindering a conduction of cations and suppressing interfacial peeling between the protective layer A and the structure. The silicon compound may contain at least one element selected from the group consisting of oxygen, nitrogen, and carbon from the viewpoint of high adhesiveness to the structure and hindrance to conduction of cations. In particular, the silicon compound may be at least one compound selected from the group consisting of SiC, SiOC, SiCN, SiOCN, SiO, SiN, and SiON. Further, the silicon compound may be a silicon compound containing a carbon element because resistance to the liquid is provided to the intermediate layer A itself. In particular, at least one compound selected from the group consisting of SiC, SiOC, SiCN, and SiOCN can be used. In the case where the silicon compound contains carbon atoms, the composition ratio of carbon atoms to the total of silicon atoms and carbon atoms contained in the silicon compound is preferably 15 atomic percent or more, more preferably 20 atomic percent or more, and further preferably 25 atomic percent or more. This is because corrosion resistance to alkali solutions is enhanced by setting the composition ratio of carbon atoms to be 15 atomic percent or more. There is no particular limitation regarding the upper limit of the range of the composition ratio of carbon atoms and, for example, 80 atomic percent or less, and in particular, 60 atomic percent or less may be used. The method for forming the intermediate layer A may be appropriately selected from the film formation methods, e.g., a CVD method, a sputtering method, an atomic layer deposition method, and a lift-off method.

As described above, the protective layer A ensures the corrosion resistance to alkali solutions but may be crystallized or altered by hydrogen ions and water molecules. Therefore, the mass density of the intermediate layer A can be increased from the viewpoint of suppressing a reaction between hydrogen ions and water molecules that have penetrated the intermediate layer A and the protective layer A. Specifically, the mass density of the intermediate layer A is preferably 1.70 g/cm$^3$ or more, more preferably 1.80 g/cm$^3$ or more, further preferably 1.90 g/cm$^3$ or more, and particularly preferably 2.00 g/cm$^3$ or more. There is no particular limitation regarding the upper limit of the range of mass density, and 5.00 g/cm$^3$ or less, and in particular, 3.00 g/cm$^3$ or less is used. In the case where the intermediate layer A is formed by, for example, a plasma CVD method, the mass density of the intermediate layer A is set to be a predetermined value by controlling the production conditions, e.g., pressure in a film formation chamber during film formation. Specifically, the mass density is increased by decreasing the pressure in the film formation chamber during film formation. The thickness of the intermediate layer A is preferably 5 nm or more because the adherence between the protective layer A and the structure is enhanced. There is no particular limitation regarding the upper limit of the thickness, and 20 μm or less is preferable from the viewpoint of film stress. The thickness is more preferably 10 to 500 nm and further preferably 20 to 100 nm.

The organic resin contained in the structure can be at least one resin selected from the group consisting of an epoxy resin, an aromatic polyimide resin, an aromatic polyamide resin, and an aromatic hydrocarbon resin because the mechanical strength is high and the corrosion resistance to the liquid is high. Further, the organic resin can be an epoxy resin or an aromatic polyimide resin because the corrosion resistance to the liquid is high. These organic resins may be used alone, or at least two may be used in combination. The content of the organic resin in the structure is preferably 80 percent by mass or more. The content is more preferably 90 percent by mass or more, and further preferably 100 percent by mass; that is, the structure can be composed of the organic resin.

Figure 3A:
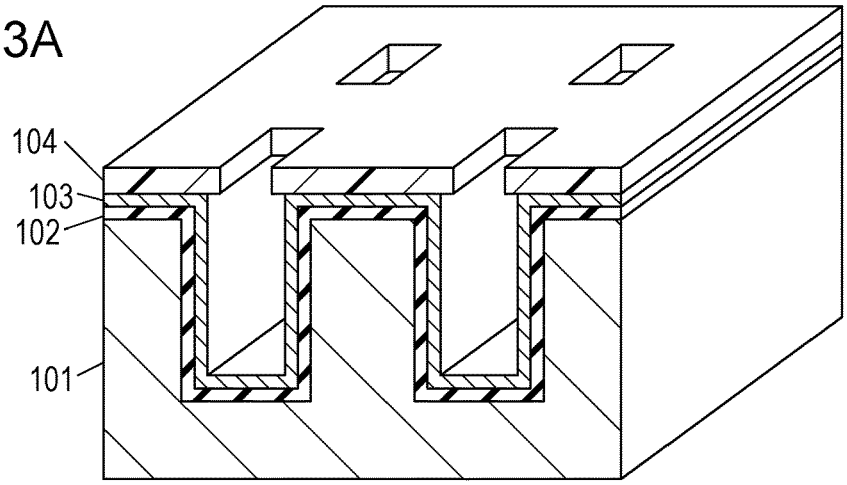
FIGS. 3A to 3C are sectional views showing an example of the substrate.
Figure 3B:
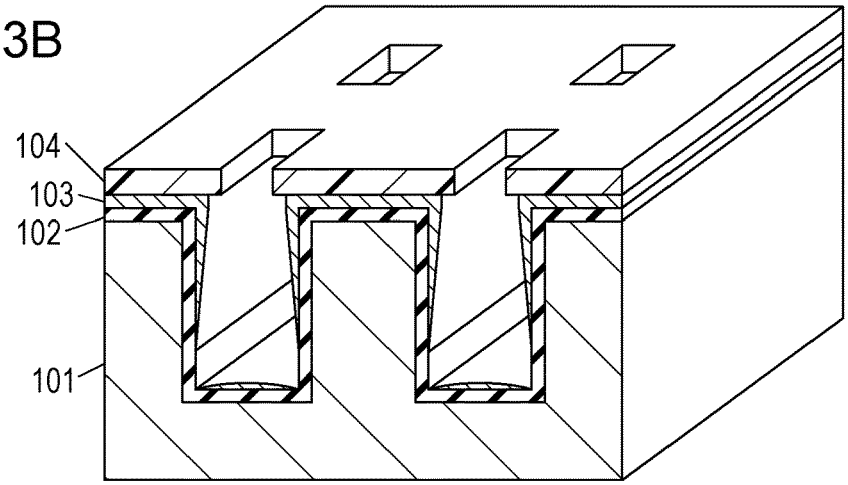
Figure 3C:
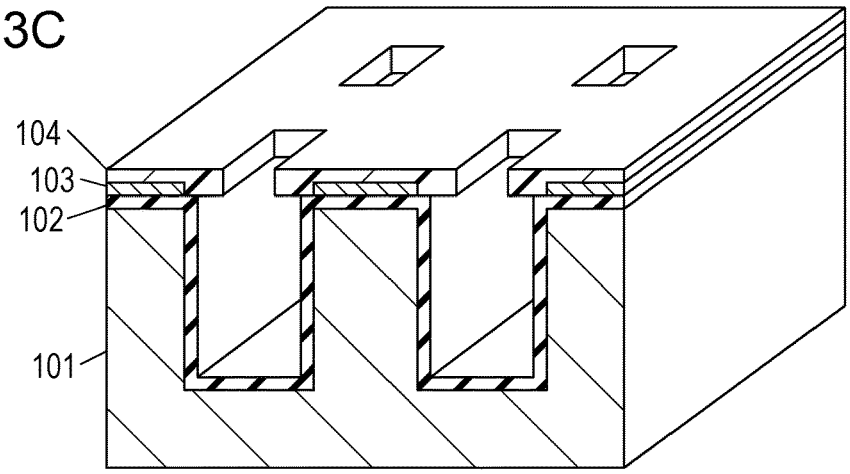

The structure may have some mechanical structures, e.g., a liquid flow passage. For example, as shown in FIGS. 3A to 3C, recessed portions, e.g., flow passage structures, can be disposed on a first surface of a silicon substrate 101, and a structure 104 can be a lid structure disposed over the recessed portions. As shown in FIGS. 3A to 3C, the lid structure may be provided with opening portions, each of which communicates with part of a recessed portion. The thickness of the structure may be, for example, 10 μm or more and 1,000 μm or less. In FIG. 3A, an intermediate layer A 103 is disposed across the entire side surface of each of the recessed portions. In FIG. 3B, the intermediate layer A 103 is disposed on a part of the side surface of each of the recessed portions. Each of these corresponds to the substrate shown in FIG. 1A because the intermediate layer A is disposed across the entire interface between the structure 104 and the protective layer A 102. Meanwhile, in FIG. 3C, the intermediate layer A 103 is disposed at some portions of the interface between the structure 104 and the protective layer A 102 and, therefore, corresponds to the substrates shown in FIG. 1B and FIG. 2A. In this regard, the intermediate layer A 103 shown in FIG. 3A may be produced by, for example, the atomic layer deposition method and may also be obtained by the CVD method in the case where the aspect ratio of the opening is small. The intermediate layer A 103 shown in FIG. 3B may be produced by, for example, the CVD method or the sputtering method. The intermediate layer A 103 shown in FIG. 3C may be produced by, for example, the lift-off method. As shown in FIGS. 3A to 3C, from the viewpoint of more satisfactorily suppressing corrosion of silicon due to the liquid, the entire exposed silicon surface can be covered with a single-piece protective layer without leaving any space. That is, the side walls of the recessed portions and at least the first surface of the silicon substrate 101 can be covered with the continuous protective layer A 102. In this regard, in the substrates shown in FIGS. 3A to 3C, through holes that penetrate as far as the second surface opposite to the first surface of the silicon substrate may be located in place of the recessed portions.

Figure 10:
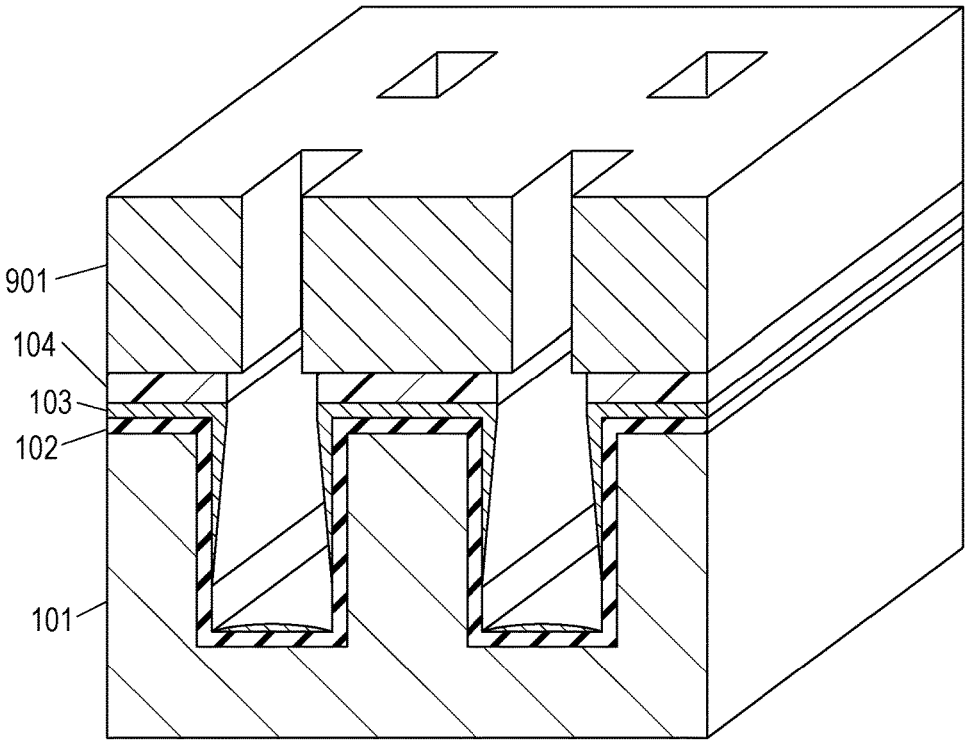
FIG. 10 is a sectional view showing an example of the substrate.
Figure 11:
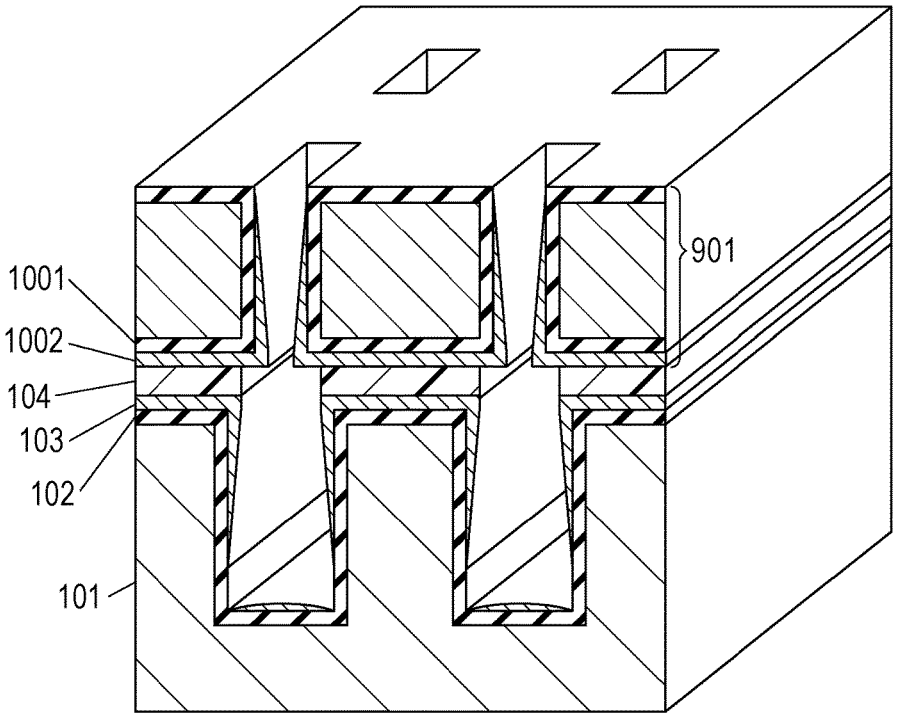
FIG. 11 is a sectional view showing an example of the substrate.

As shown in FIG. 10, a member 901 may be bonded to a silicon substrate 101 with a structure 104 interposed therebetween. In this case, the structure 104 may be used as an adhesive agent for bonding the member 901 to the silicon substrate 101. Meanwhile, in the case where the structure 104 is not an adhesive agent, after the organic resin constituting the structure 104 is cured, the member 901 may be directly bonded to the silicon substrate 101 by plasma activation. In each case, the structure 104 constitutes some portions of the flow passages of the liquid. The member 901 can be a member having a lid structure disposed over the recessed portions provided in the silicon substrate 101 in the same manner as the structure 104 shown in FIGS. 3A to 3C. As shown in FIG. 10, opening portions that communicate with some portions of the recessed portions may be located in the member 901. The material for forming the member 901 is appropriately selected from various materials, e.g., alumina, SUS, resins, and silicon. In the case where the base material of tree member 901 is silicon, the member 901 may have the same configuration as the configuration of the silicon substrate 101, as shown in FIG. 11. That is, the surface of the member 901 may be covered with a protective layer B 1001 containing a metal oxide, and an intermediate layer B 1002 may be disposed between the protective layer B 1001 and a structure 104. In this case, the member 901 is also an embodiment that is a target of the present invention. Further, in the case where another member is successively bonded, the other member may also have the same structure as the structure of the member 901. In the substrate shown in FIG. 10, through holes that penetrate as far as the second surface opposite to the first surface of the silicon substrate may be located in place of the recessed portions.

Figure 8:
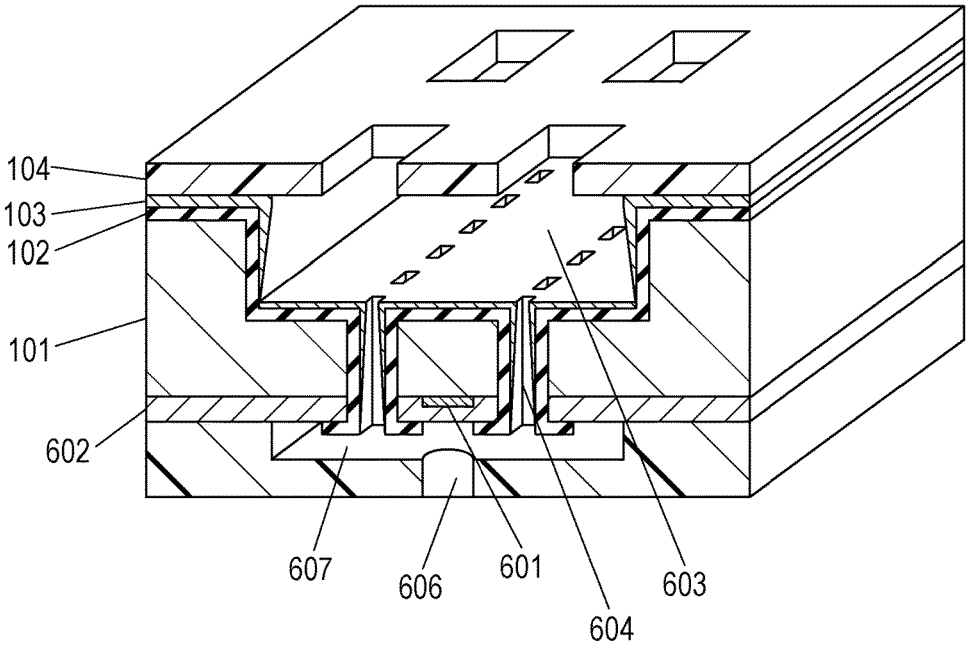
FIG. 8 is a sectional view showing an example of the liquid ejection head.

FIG. 8 shows an example of the liquid ejection head. The liquid ejection head shown in FIG. 8 includes a protective layer A 102 on a first surface of a silicon substrate 101, a structure 104 on the protective layer A 102, and an intermediate layer A 103 between the protective layer A 102 and the structure 104. A liquid flow passage 603 serving as a flow passage structure is made in the first surface of the silicon substrate 101. The silicon substrate 101 includes liquid supply passages 604. The structure 104 is a lid structure having opening portions that communicate with the flow passage 603. An energy generating element 601 and a wiring layer 602 including a drive circuit and wiring lines for supplying electric power to the energy generating element 601 are disposed on the second surface opposite to the first surface of the silicon substrate 101. A flow passage forming member constitutes a pressure chamber 607 provided with the energy generating element 601 therein and a liquid ejection port 606. A liquid supplied to the flow passage 603 through the opening portions of the structure 104 is retained in the pressure chamber 607 by supply passages 604 and is ejected to the outside from the ejection port 606 due to energy applied by the energy generating element 601. The liquid in the pressure chamber may be circulated between the inside of the pressure chamber and the outside of the pressure chamber. That is, the liquid in the pressure chamber 607 may be removed to the outside through any hole section and may be returned again into the pressure chamber 607 through any hole section. For example, the liquid in the pressure chamber 607 may be circulated to the first surface side of the silicon substrate 101 through the through holes included in the silicon substrate 101. Specifically, for example, in FIG. 8, the liquid may enter the pressure chamber 607 from the right supply passage 604, exit through the left supply passage 604 so as to enter the flow passage 603, and return into the pressure chamber 607 from the right supply passage 604. In FIG. 8, the left supply passage 604 and the right supply passage 604 are through holes that extend from one flow passage 603 toward the first surface side of the silicon substrate 101. However, the configuration in which the flow passage 603 is divided into two parts, the left supply passage 604 extending from one flow passage and the right supply passage 604 extending from the other flow passage, may be used. In the case where such a configuration is used, a liquid inlet path into the pressure chamber 607 and a liquid outlet path from the pressure chamber 607 are separated and, thereby, the liquid is circulated efficiently.

In the liquid ejection head, because of the structural feature thereof, the reliability, of between the structure and the substrate and between the flow passage forming member and the substrate is important. In general, in an ink-jet printer, ink passages for inks of multiple colors are disposed in the liquid ejection head because inks of multiple colors are supplied for the purpose of forming color images. For example, in the sectional view of the liquid ejection head shown in FIG. 8, flow passages of inks of different colors are disposed so as to adjoin the flow passage 603 in the left direction and the right direction in the sectional view. If peeling from the substrate occurs between these flow passages of the inks of different colors, color mixing of the inks may occur, and normal images may not be formed in some cases.

In particular, the contact area between the substrate and the structure is smaller than the contact area between the flow passage forming member and the substrate and, therefore, even a small extent of peeling between the structure and the substrate tends to be linked to color mixing of the inks. Specifically, in the liquid ejection head shown in FIG. 8, the flow passage 603 is in need of having sufficient width for the purpose of stably supplying the liquid to many ejection ports 606 arrayed in the direction perpendicular to the cross section. Consequently, the width of the flow passage 603 is usually larger than the width of the pressure chamber 607. For example, the width of the pressure chamber 607 is 30 μm or more and 300 μm or less, whereas the width of the flow passage 603 is 350 μm or more and 1,000 μm less. Therefore, the width of the portion, in which the second surface side of the silicon substrate 101 is in contact with the flow passage forming member is larger than the width of the portion, in which the first surface side of the silicon substrate 101 is in contact with the structure 104 and the flow passage 603 is not provided. As a result, even a small extent of peeling between the silicon substrate 101 and the structure 104, that is, the first surface side of the silicon substrate, tends to cause color mixing of the inks and, therefore, high reliability of adhesion is required.

In the liquid ejection head, the structure may constitute a flow passage forming member, an ejection port forming member, a protective member, and the like. In this case, the energy generating element is disposed on the first surface of the silicon substrate.

Figure 12A:
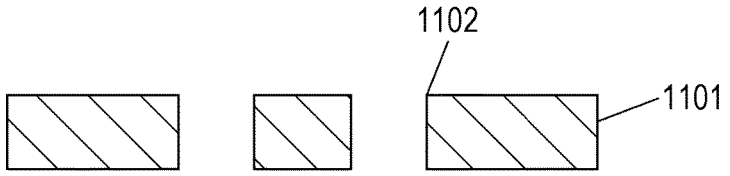
FIGS. 12A to 12E are sectional views showing the steps of producing liquid ejection heads according to the examples and the comparative examples.
Figure 12B:
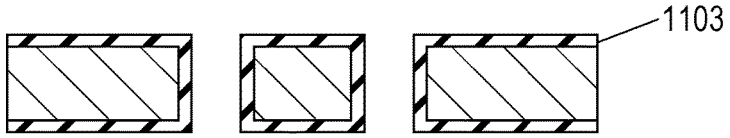
Figure 12C:
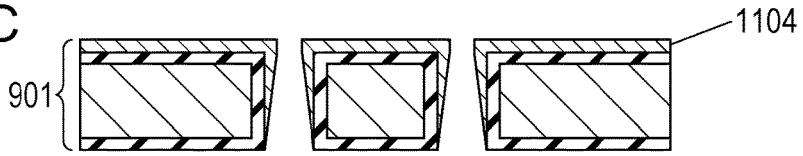
Figure 12D:
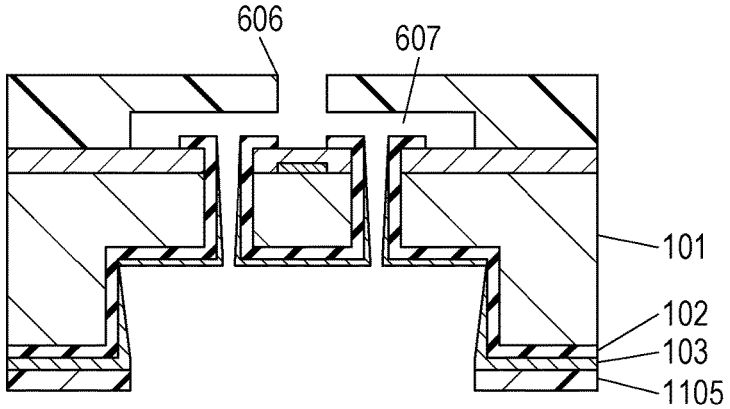
Figure 12E:
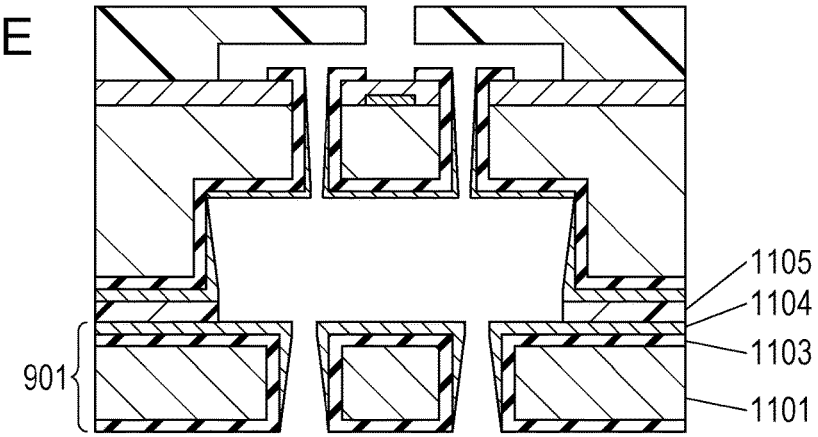
Figure 13:
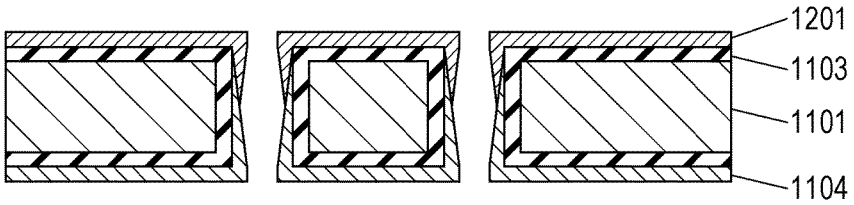
FIG. 13 is a sectional view showing an example of a member in the liquid ejection head.

FIG. 12E shows another example of the liquid ejection head. The liquid ejection head shown in FIG. 12E is the same as the liquid election head shown in FIG. 8 except a structure and a member bonded to the structure. In the liquid ejection head shown in FIG. 12E, a member 901 is bonded while a structure 1105 is interposed. The member 901 may be the same as the above-described member 901 shown in FIG. 10 or FIG. 11. In the case where a member other than the member 901 is further bonded, as shown in FIG. 13, an intermediate layer B 1201 may be disposed on not only one surface of a silicon substrate 1101 but also on the other surface in the member 901.

Printing Method

A printing method performs printing by ejecting a liquid containing a pigment from the above-described liquid ejection head. In the printing method, the above-described liquid ejection head is used and, therefore, even in the case where the liquid containing a pigment is passed through the liquid ejection head in the long term, interfacial peeling between the protective layer A and the structure is suppressed.

EXEMPLARY EMBODIMENTS

Examples 1 and 2 and Comparative Example 1

In the present example, a substrate was produced by the steps shown in FIGS. 4A to 4D. A silicon substrate 101 was prepared. An atomic layer deposition method (ALD method) was used and 85 nm of TiO film serving as a protective layer A 102 was formed. A plasma CVD method was used and 50 nm of SiC film having a mass density of 2.01 g/cm$^3$ and serving as an intermediate layer A 103 was formed (FIG. 4A). In this regard, the mass density of the intermediate layer A was calculated from the total reflection critical angle of an X-ray by using X-ray reflectometry (XRR). In the other examples and comparative examples below, the mass densities were calculated by the same method.

Both surfaces of the silicon substrate 101 were coated with a photoresist 405 (trade name: THMR-iP5700 HR, produced by TOKYO OHKA KOGYO CO., LTD.), and development was performed by irradiating a half area of the first surface of the silicon substrate 101 with UV light. In this manner, patterns 401, 402, and 403, in which exposure ranges of the intermediate layer A 103 were different from each other, were formed (FIG. 4B). In the pattern 401, the entire intermediate layer A 103 was exposed. The pattern 402 was a pattern having a square hole with one side of 180 μm. The pattern 403 was a pattern having a square hole with one side of 220 μm.

The exposed intermediate layer A 103 was etched by reactive ion etching, in which $CH_4$ gas was used (FIG. 4C). Thereafter, the photoresist 405 was peeled by using a stripping solution. The first surface was coated with an epoxy resin (trade name: TMMR, produced by TOKYO OHKA KOGYO CO., LTD.) so as to form a structure 104. A photomask and an exposure apparatus (projection aligner (trade name: UX-4258, produced by USHIO INC.)) were used and a pattern having square holes with one side of 200 μm was formed (FIG. 4D). The epoxy resin was cured by being heated to 200° C. so as to produce the substrate.

The substrate was cut into pieces along two lines shown in FIGS. 4B to 4D. The piece including the pattern 401 was specified as the substrate of comparative example 1, the piece including the pattern 402 was specified as the substrate of example 1, and the piece including the pattern 403 was specified as the substrate of example 2. Regarding the proportion of the contact area between the structure 104 and the intermediate layer A 103 relative to the contact area between the structure 104 and the protective layer A 102 or the intermediate layer A 103 when projected in a direction perpendicular to the first surface of the silicon substrate 101 (interface coverage of intermediate layer A 103), example 1 was 100%, example 2 was 80%, and comparative example 1 was 0% (intermediate layer A 103 was not present).

Each substrate was dipped into pigment black ink (cartridge name: PFI-106 BK) for a large-format ink-let printer (trade name: imagePROGRAF series) produced by CANON KABUSHIKI KAISHA for 2 weeks while being heated to 70° C. Each substrate taken out of the ink was washed with pure water and was observed by using an electron microscope.

Figure 5A:
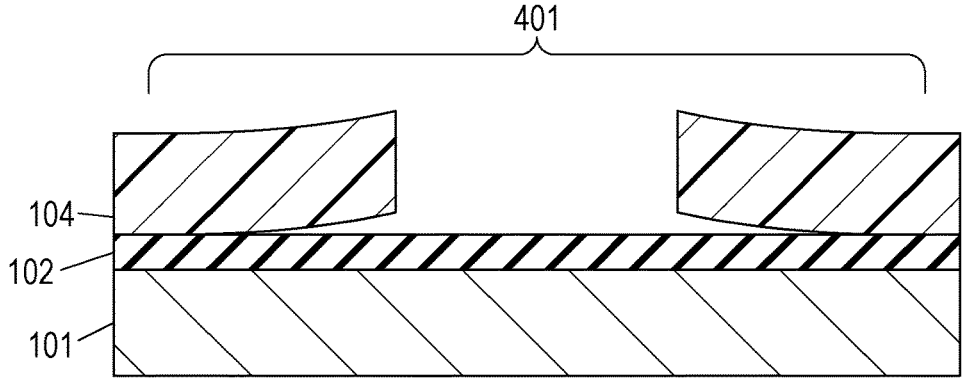
FIGS. 5A to 5C are sectional views showing evaluation results of ink dipping of the substrates according to the examples and the comparative examples.

Regarding the substrate of comparative example 1, that is, the substrate, in which the intermediate layer A 103 was not present between the structure 104 and the protective layer A 102, with the pattern 401, interfacial peeling occurred between the structure 104 and the protective layer A 102 in the periphery of the square hole pattern provided to the structure 104 (FIG. 5A).

Figure 5B:
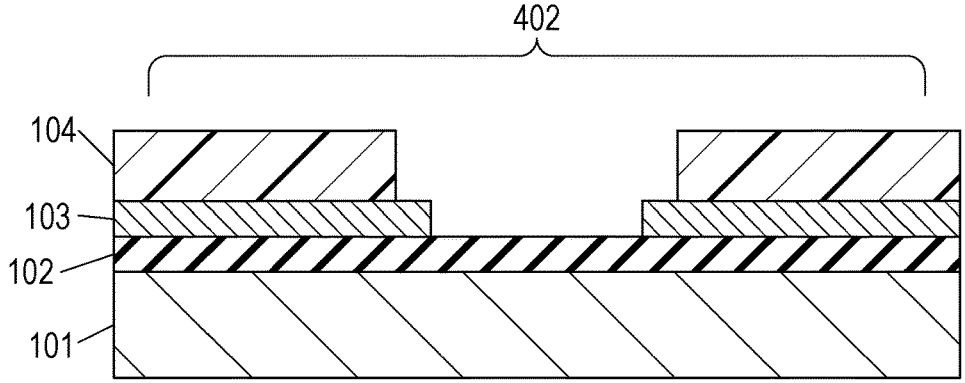
Figure 5C:
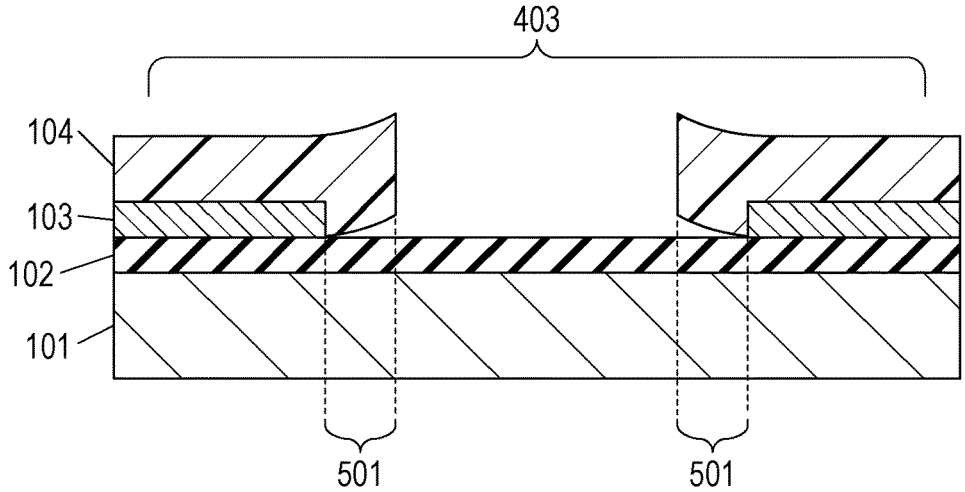

Meanwhile, regarding the substrate of example 1, that is, the substrate, in which the structure 104 was entirely separated from the protective layer A 102 by the intermediate layer A 103, with the pattern 402, interfacial peeling did not occur between the structure 104 and the protective layer A 102 (FIG. 5B). Regarding the substrate of example 2, that is, the substrate, in which the intermediate layer A 103 was cut partway and the structure 104 was in contact with the protective layer A 102 in a region 501, with the pattern 403, interfacial peeling occurred between the structure 104 and the protective layer A 102 in the region 501. However, the interfacial peeling did not occur in a region in which the intermediate layer A 103 was present (FIG. 5C).

Example 3 and 4 and Comparative Example 2

Substrates were produced in the same manner as examples 1 and 2 and comparative example 1 except that a SiOC film having a mass density of 2.00 g/cm$^3$ was used in place of the SiC film serving as the intermediate layer A 103, and ink dipping evaluation was performed. The evaluation results were the same as those of examples 1 and 2 and comparative example 1.

Examples 5 and 6 and Comparative Example 3

Substrates were produced in the same manner as examples 1 and 2 and comparative example 1 except that a SiCN film having a mass density of 2.10 g/cm$^3$ was used in place of the SiC film serving as the intermediate layer A 103, and ink dipping evaluation was performed. The evaluation results were the same as those of examples 1 and 2 and comparative example 1.

Examples 7 and 8 and Comparative Example 4

Substrates were produced in the same manner as examples 1 and 2 and comparative example 1 except that a SiOCN film having a mass density of 2.07 g/cm$^3$ was used in place of the SiC film serving as the intermediate layer A 103, and ink dipping evaluation was performed. The evaluation results were the same as those of examples 1 and 2 and comparative example 1.

Examples 9 and 10 and Comparative Example 5

A protective layer A 102 and an intermediate layer A 103 were formed on a silicon substrate 101 in the same manner as examples 1 and 2 and comparative example 1. An aromatic polyamide resin (trade name: HIMAL HL-1200CH, produced by Hitachi Chemical Company, Ltd.) was applied and heat-drying was performed. A photoresist (trade name: THMR-iP5700 HR, produced by TOKYO OHKA KOGYO CO., LTD.) was further applied, and a pattern was formed by using a photomask and an exposure apparatus (projection aligner (trade name: UX-4258, produced by USHIO INC.)). The pattern of the above-described photoresist was used as a mask, and the aromatic polyamide resin was etched by chemical dry etching that used oxygen plasma. Thereafter, the above-described photoresist was peeled so as to form a structure 104 having the same pattern as the patterns of examples 1 and 2 and comparative example 1. Subsequently, substrates were produced in the same manner as examples 1 and 2 and comparative example 1, and ink dipping evaluation was performed. The evaluation results were the same as those of examples 1 and 2 and comparative example 1.

Examples 11 and 12 and Comparative Example 6

Substrates were produced in the same manner as examples 1 and 2 and comparative example 1 except that a SiC film having a mass density of 1.68 q/cm$^3$ was used as the intermediate layer A 103, and ink dipping evaluation was performed. The evaluation results were the same as those of examples 1 and 2 and comparative example 1. However, in the substrates of examples 11 and 12, it was observed that the protective layer A 102 crystallized into the shape of spots having diameters within the range of about 100 μm in some of the bonding portions between the intermediate layer A 103 and the protective layer A 102. In this regard, peeling occurred between the substrate 101 and the protective layer A 102 in crystallized portions, although peeling of the structure 104 did not occur and the function of the intermediate layer A 103 was not impaired.

Examples 13 and 14 and Comparative Example 7

Substrates were produced in the same manner as examples 1 and 2 and comparative example 1 except that a SiC film having a mass density of 1.71 g/cm$^3$ was used as the intermediate layer A 103, and ink dipping evaluation was performed. The evaluation results were the same as those of examples 1 and 2 and comparative example 1. However, in the substrates of examples 13 and 14, it was observed that the protective layer A 102 crystallized into the shape of spots having diameters within the range of about 100 μm in some of the bonding portions between the intermediate layer A 103 and the protective layer A 102. In this regard, peeling occurred between the substrate 101 and the protective layer A 102 in crystallized portions, although peeling of the structure 104 did not occur and the function of the intermediate layer A 103 was not impaired.

Examples 15 and 16 and Comparative Example 8

Substrates were produced in the same manner as examples 1 and 2 and comparative example 1 except that a SiC film having a mass density of 1.81 g/cm$^3$ was used as the intermediate layer A 103, and ink dipping evaluation was performed. The evaluation results were the same as those of examples 1 and 2 and comparative example 1. However, in the substrates of examples 15 and 16, it was observed that the protective layer A 102 crystallized into the shape of spots having diameters within the range of about 100 μm in some of the bonding portions between the intermediate layer A 103 and the protective layer A 102. In this regard, peeling occurred between the substrate 101 and the protective layer A 102 in crystallized portions, although peeling of the structure 104 did not occur and the function of the intermediate layer A 103 was not impaired.

Examples 17 and 16 and Comparative Example 9

Substrates were produced in the same manner as examples 1 and 2 and comparative example 1 except that a SiCN film having a mass density of 1.78 g/cm$^3$ was used as the intermediate layer A 103, and ink dipping evaluation was performed. The evaluation results were the same as those of examples 1 and 2 and comparative example 1. However, in the substrates of examples 17 and 18, it was observed that the protective layer A 102 crystallized into the shape of spots having diameters within the range of about 100 μm in some of the bonding portions between the intermediate layer A 103 and the protective layer A 102 in this regard, peeling occurred between the substrate 101 and the protective layer A 102 in crystallized portions, although peeling of the structure 104 did not occur and the function of the intermediate layer A 103 was not impaired.

Examples 19 and 20 and Comparative Example 10

Substrates were produced in the same manner as examples 1 and 2 and comparative example 1 except that a SiOC film having a mass density of 1.69 g; cm$^3$ was used as the intermediate layer A 103, and ink dipping evaluation was performed. The evaluation results were the same as those of examples 1 and 2 and comparative example 1. However, in the substrates of examples 19 and 20, it was observed that the protective layer A 102 crystallized into the shape of spots having diameters within the range of about 100 μm in some of the bonding portions between the intermediate layer A 103 and the protective layer A 102. In this regard, peeling occurred between the substrate 101 and the protective layer A 102 in crystallized portions, although peeling of the structure 104 did not occur and the function of the intermediate layer A 103 was not impaired.

Table shows the material for forming the intermediate layer A, the mass density of the intermediate layer A, the composition ratio of carbon atoms in the silicon compound, the interface coverage of the intermediate layer A, the material for forming the structure, the ink dipping evaluation result, and the number of spot-like crystallization portions, which were generated during the ink dipping evaluation, per piece in each of examples 1 to 20 and comparative examples 1 to 10.

TABLE

| | Material for intermediate layer A | Mass density of intermediate layer A (g/cm$^3$) | Composition ratio of carbon atoms in silicon compound (atomic %) | Interface coverage of intermediate layer A (%) | Material for structure | Ink dipping evaluation result | Number of spot-like crystallization portions |
|---|---|---|---|---|---|---|---|
| Example 1 | SiC | 2.01 | 30 | 100 | epoxy resin | no interfacial peeling | 0 |
| Example 2 | SiC | 2.01 | 30 | 80 | epoxy resin | partial interfacial peeling | 0 |
| Example 3 | SiOC | 2.00 | 25 | 100 | epoxy resin | no interfacial peeling | 0 |
| Example 4 | SiOC | 2.00 | 25 | 80 | epoxy resin | partial interfacial peeling | 0 |

TABLE-continued

| | Material for intermediate layer A | Mass density of intermediate layer A ($g/cm^3$) | Composition ratio of carbon atoms in silicon compound (atomic %) | Interface coverage of intermediate layer A (%) | Material for structure | Ink dipping evaluation result | Number of spot-like crystallization portions |
|---|---|---|---|---|---|---|---|
| Example 5 | SiCN | 2.10 | 28 | 100 | epoxy resin | no interfacial peeling | 0 |
| Example 6 | SiCN | 2.10 | 28 | 80 | epoxy resin | partial interfacial peeling | 0 |
| Example 7 | SiOCN | 2.07 | 18 | 100 | epoxy resin | no interfacial peeling | 0 |
| Example 8 | SiOCN | 2.07 | 18 | 80 | epoxy resin | partial interfacial peeling | 0 |
| Example 9 | SiC | 2.01 | 30 | 100 | aromatic polyamide resin | no interfacial peeling | 0 |
| Example 10 | SiC | 2.01 | 30 | 80 | aromatic polyamide resin | partial interfacial peeling | 0 |
| Example 11 | SiC | 1.68 | 59 | 100 | epoxy resin | no interfacial peeling | >50 |
| Example 12 | SiC | 1.68 | 59 | 80 | epoxy resin | partial interfacial peeling | >50 |
| Example 13 | SiC | 1.71 | 54 | 100 | epoxy resin | no interfacial peeling | 21 |
| Example 14 | SiC | 1.71 | 54 | 80 | epoxy resin | partial interfacial peeling | 18 |
| Example 15 | SiC | 1.81 | 48 | 100 | epoxy resin | no interfacial peeling | 3 |
| Example 16 | SiC | 1.81 | 48 | 80 | epoxy resin | partial interfacial peeling | 2 |
| Example 17 | SiCN | 1.78 | 52 | 100 | epoxy resin | no interfacial peeling | 14 |
| Example 18 | SiCN | 1.78 | 52 | 80 | epoxy resin | partial interfacial peeling | 13 |
| Example 19 | SiOC | 1.69 | 61 | 100 | epoxy resin | interfacial peeling | >50 |
| Example 20 | SiOC | 1.69 | 61 | 80 | epoxy resin | partial interfacial peeling | >50 |
| Comparative Example 1 | — | — | — | 0 | epoxy resin | interfacial peeling | — |
| Comparative Example 2 | — | — | — | 0 | epoxy resin | interfacial peeling | — |
| Comparative Example 3 | — | — | — | 0 | epoxy resin | interfacial peeling | — |
| Comparative Example 4 | — | — | — | 0 | epoxy resin | interfacial peeling | — |
| Comparative Example 5 | — | — | — | 0 | aromatic polyamide resin | interfacial peeling | — |
| Comparative Example 6 | — | — | — | 0 | epoxy resin | interfacial peeling | — |
| Comparative Example 7 | — | — | — | 0 | epoxy resin | interfacial peeling | — |
| Comparative Example 8 | — | — | — | 0 | epoxy resin | interfacial peeling | — |
| Comparative Example 9 | — | — | — | 0 | epoxy resin | interfacial peeling | — |
| Comparative Example 10 | — | — | — | 0 | epoxy resin | interfacial peeling | — |

Example 21

Figure 6A:
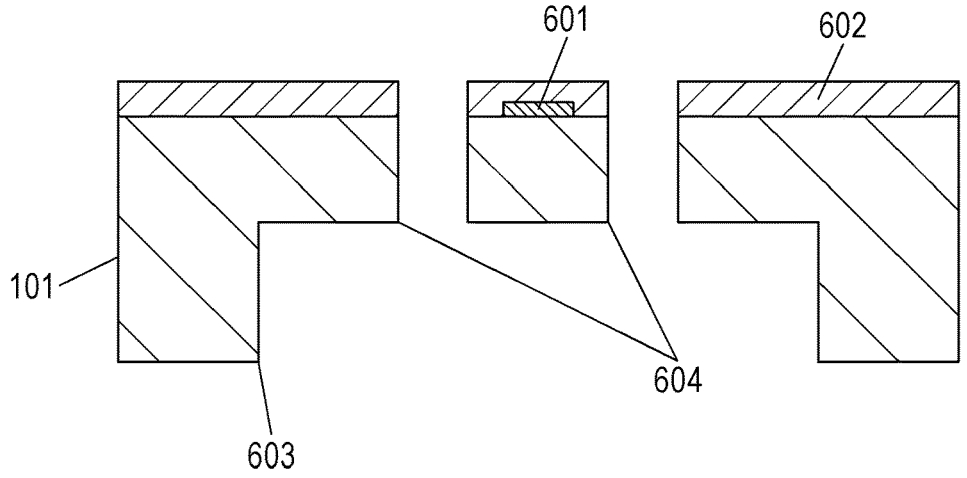
FIGS. 6A to 6C are sectional views showing the steps of producing ejection heads according to the examples and the comparative examples.

In the present example, a liquid ejection head was produced by the steps shown in FIGS. 6A to 6C and FIGS. 7A to 7C. A silicon substrate 101 having a thickness of 625 μm was prepared (FIG. 6A). An energy generating element 601 serving as a heater was disposed in advance on a second surface of the silicon substrate 101. Likewise, a wiring layer 602 including a drive circuit and wiring lines for supplying an electric power to the energy generating element 601 had been disposed. A liquid flow passage 603 that was a recessed portion having a depth of about 500 μm had been provided in a first surface opposite to the second surface of the silicon substrate 101. Also, liquid supply passages 604 that communicated with the flow passage 603 from the second surface of the silicon substrate 101 had been disposed.

Figure 6B:
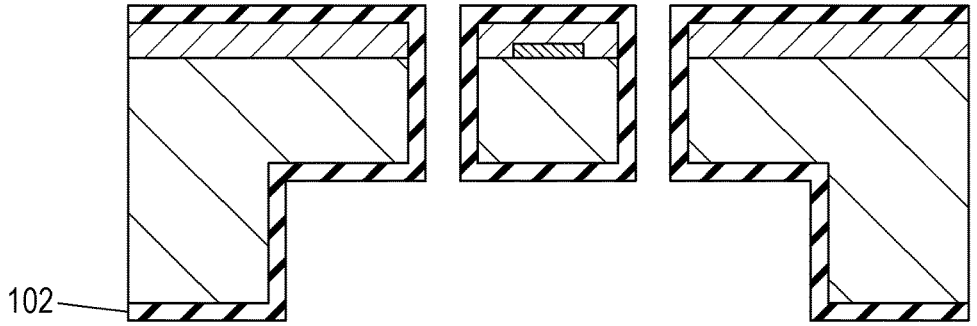

A TiO film serving as a protective layer A 102 and having a thickness of 85 nm was formed on the silicon substrate 101 by the atomic layer deposition method (FIG. 6B). The TiO film having an almost uniform thickness could be formed on the inner walls of the flow passage 603 and the supply passages 604 because the TiO film was formed by the atomic layer deposition method.

Figure 6C:
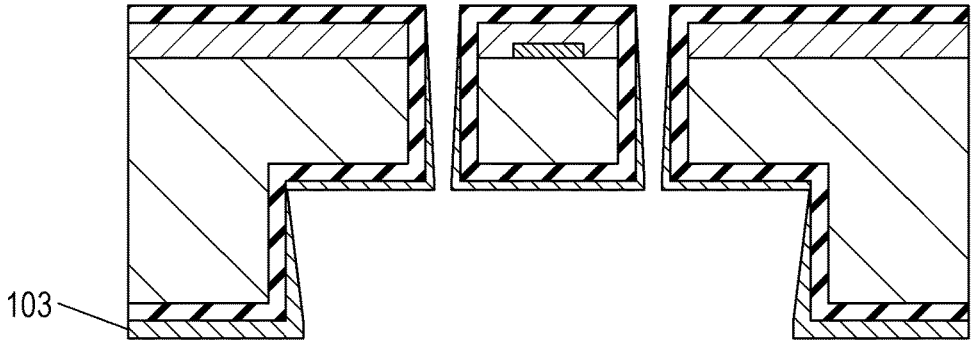

A SiC film having a mass density of 2.01 $g/cm^3$ and a thickness of 50 nm was formed, from the first surface side, as an intermediate layer A 103 by a plasma CVD method (FIG. 6C). As shown in FIG. 6C, it was ascertained that the intermediate layer A 103 was formed on the first surface so as to have a target film thickness of 50 nm, and the film thickness of the intermediate layer A 103 formed on the side wall of the flow passage 603 decreased with increasing depth from the first surface.

Figure 7A:
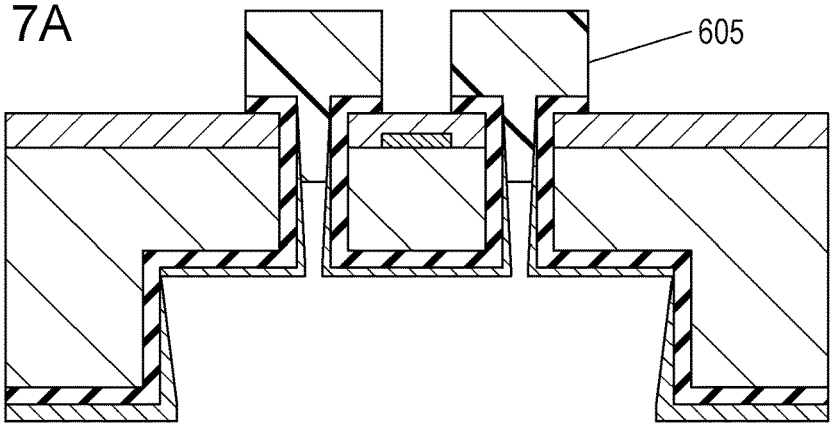
FIGS. 7A to 7C are sectional views showing the steps of producing the liquid ejection heads according to the examples and the comparative examples.

A photoresist made into a film was laminated on the second surface of the silicon substrate 101, and a pattern 605 of the photoresist was formed only in the peripheral portions of the supply passages 604 by using a photomask and an exposure apparatus (trade name: FPA-5510iV, produced by CAM KABUSHIKT KATSHA). Thereafter, the pattern 605 was used as a mask, and the protective layer A 102 on the second surface of the silicon substrate 101 was etched (FIG. 7A). A buffered hydrofluoric acid produced by mixing a buffered hydrofluoric acid (trade name: BHF-110U, produced by Daikin Industries, Ltd.) for a semiconductor with pure water at a ratio (volume ratio) of 1:40 was used as an etching liquid. Here, a spin etching method, in which an etching liquid was dropped while the silicon substrate 101 was rotated, was used. Therefore, the etching liquid did not go around the first surface of the silicon substrate 101 and only an unnecessary portion of the protective layer A 102 was removed. Subsequently, the pattern 605 used as the mask was removed.

Figure 7B:
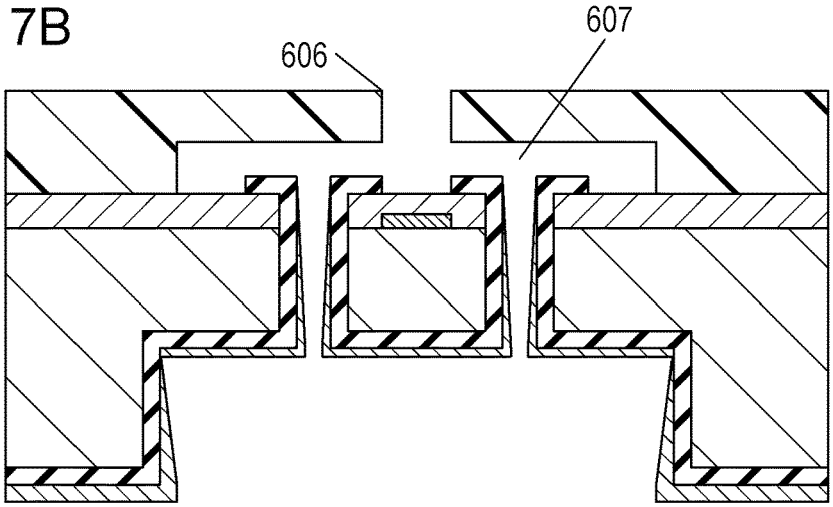

Step of laminating a photosensitive epoxy resin (trade name: TMMF, produced by TOKYO OHKA KOGYO CO., LTD.) made into a film and performing exposure and development were repeated 2 times. Consequently, a flow passage for member including a liquid election port 606 and a pressure chamber 607 extending from the supply passages 604 to the election port 606 was formed on the second surface side of the silicon substrate 101 (FIG. 7B).

Figure 7C:
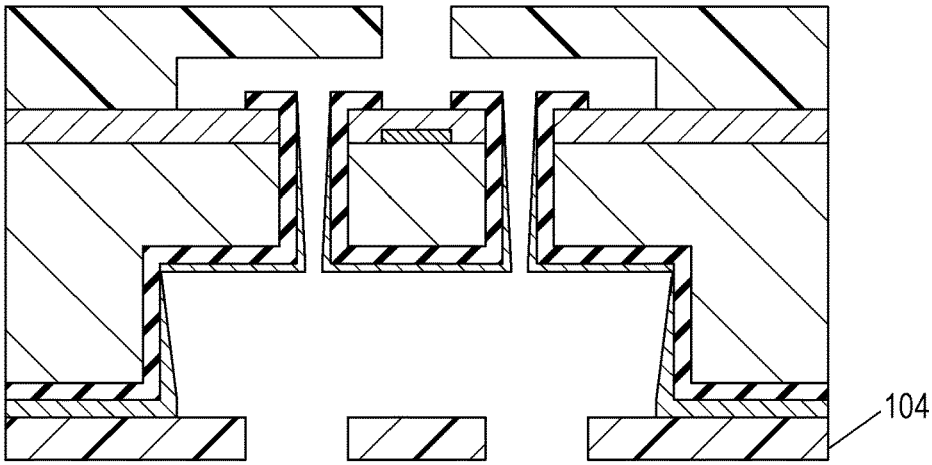

A structure 104 that was a lid structure having opening portions communicating with the flow passage 603 was formed on the first surface of the silicon substrate 101 by laminating a photosensitive epoxy resin made into a film and performing exposure and development (FIG. 7C). The photosensitive epoxy resin made into a film was produced by coating an optical film with an epoxy-resin-containing solution (trade name: SU-8 2000, produced by Nippon Kayaku Co., Ltd.) and performing drying. Thereafter, a liquid ejection head was produced by performing heating to 200° C. so as to cure the epoxy resin (FIG. 8).

The liquid ejection head was divided into pieces by using a dicing saw. Each piece was dipped into pigment black ink (cartridge name: PFI-106 BK) for a large-format ink-jet printer (trade name: imagePROGRAF series) produced by CANON KABUSHIKI KAISHA for 2 weeks while being heated to 70° C. Each liquid ejection head taken out of the ink was washed with pure water and was observed. As a result, the structure 104 did not change, and interfacial peeling did not occur between the structure 104 and the protective layer A 102.

COMPARATIVE EXAMPLE 11

A liquid ejection head was produced in the same manner as example 21 except that the intermediate layer A 103 was not formed, and ink dipping evaluation was performed. In the present comparative example, the structure 104 peeled in the vicinity of the flow passage 603 where the structure 104 was in contact with the protective layer A 102.

Example 22

In the present example, a liquid ejection head was produced by the steps shown in FIGS. 12A to 12E. A silicon substrate 1101 having a thickness of 625 μm was prepared (FIG. 12A). Liquid supply passages 1102 were located in the silicon substrate 1101. A TiO film serving as a protective layer B 1103 and having a thickness of 85 nm was formed on the silicon substrate 1101 by the atomic layer deposition method (FIG. 12B). The protective layer B 1103 having an almost uniform thickness could also be formed on the inner walls of the supply passages 1102 because the TiO film was formed by the atomic layer deposition method. A SiC film having a mass density of 2.01 g/cm$^3$ and a thickness of 50 nm was formed as an intermediate layer B 1104 on one surface of the silicon substrate 1101 by a plasma CVD method (FIG. 12C). In this manner, a member 901 was produced.

A liquid ejection head in the state shown in FIG. 7B was produced in the same manner as example 21. Thereafter, a structure 1105 that was an organic resin layer was formed on the first surface of the silicon substrate 101 (FIG. 12D). The structure 1105 was formed by coating a silicon wafer with a benzocyclobutene resin solution (trade name: CYCLOTEN, produced by Dow Chemical Company) having a thickness of 2 μm and performing transfer to the first surface of the silicon substrate 101.

The surface provided with the structure 1105 of the silicon substrate 101 was bonded to the surface provided with the intermediate layer B 1104 of the member 901 (FIG. 12E). The alignment of the substrates was performed by using EVG6200BA (trade name) produced by EVG, and the bonding was performed by using EVG520IS (trade name) produced by EVG. The bonding was performed by heating to 150° C., and curing was completed at 300° C. In this manner, the liquid election head was produced.

The liquid ejection head was divided into pieces by using a dicing saw. Each piece was dipped into pigment black ink (cartridge name: PFI-106 BK) for a large-format ink-jet printer (trade name: imagePROGRAF series) produced by CANON KABUSHIKI KAISEA for 2 weeks while being heated to 70° C. Each liquid ejection head taken out of the ink was washed with pure water and was observed. As a result, the structure 1105 did not change, and interfacial peeling did not occur between the structure 1105 and the protective layer B 1103.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-105149 filed May 26, 2016 and No. 2017-033306 filed Feb. 24, 2017, which are hereby incorporated by reference herein in their entirety.

What is claimed is:

1. A liquid ejection head comprising:

a silicon substrate; and an element disposed on the silicon substrate and configured to generate energy that is utilized for ejecting a liquid, wherein a protective layer A containing a metal oxide is disposed on a first surface of the silicon substrate, wherein a structure containing an organic resin and constituting part of a liquid flow passage is disposed on the protective layer A, and wherein an intermediate layer A containing a silicon compound is disposed between the protective layer A and the structure.

2. The liquid ejection head according to claim 1, wherein the element is disposed on a second surface opposite to the first surface of the silicon substrate.

3. The liquid ejection head according to claim 1, wherein the metal element in the metal oxide is titanium.

4. The liquid ejection head according to claim 1, wherein the silicon compound is a compound selected from the group consisting of SiC, SiOC, SiCN, SiOCN, SiO, SiN, and SiON.

5. The liquid ejection head according to claim 1, wherein the intermediate layer A is in direct contact with the structure and the protective layer A.

6. The liquid ejection head according to claim 5, wherein the proportion of the contact area between the structure and the intermediate layer A relative to the contact area between the structure and the protective layer A or the intermediate layer A when projected in a direction perpendicular to the first surface of the silicon substrate is 50% or more.

7. The liquid ejection head according to claim 1, wherein a recessed portion is provided in the first surface of the silicon substrate or a through hole that penetrates the silicon substrate from the first surface to the second surface opposite to the first surface is located, and wherein the structure is a lid structure disposed over the recessed portion or the through hole.

8. The liquid ejection head according to claim 7, wherein the protective layer A continuously covers a side wall of the recessed portion or a side wall of the through hole and at least the first surface of the silicon substrate.

9. The liquid ejection head according to claim 1, wherein a recessed portion is provided in the first surface of the silicon substrate or a through hole that penetrates the silicon substrate from the first surface to the second surface opposite to the first surface is located, and wherein a member having a lid structure disposed over the recessed portion or the through hole is bonded to the silicon substrate with the structure interposed therebetween.

10. The liquid ejection head according to claim 9, wherein the base material of the member is silicon, the surface of the member is covered with a protective layer B containing a metal oxide, and an intermediate layer B is disposed between the protective layer B and the structure.

11. The liquid ejection head according to claim 1, wherein the mass density of the intermediate layer A is 1.70 g/cm$^3$ or more.

12. The liquid ejection head according to claim 11, wherein the mass density of the intermediate layer A is 2.00 g/cm$^3$ or more.

13. The liquid ejection head according to claim 1, wherein the silicon compound contains carbon atoms, and the composition ratio of carbon atoms to the total of silicon atoms and the carbon atoms contained in the silicon compound is 15 atomic percent or more.

14. The liquid ejection head according to claim 1, wherein the thickness of the structure is 10 μm or more and 1,000 μm or less.

15. The liquid ejection head according to claim 1, wherein the organic resin is at least one resin selected from the group consisting of an epoxy resin, an aromatic polyimide resin, an aromatic polyamide resin, and an aromatic hydrocarbon resin.

16. The liquid ejection head according to claim 1 comprising a pressure chamber in which the element is provided, wherein a liquid in the pressure chamber is circulated between the inside of the pressure chamber and the outside of the pressure chamber.

17. The liquid ejection head according to claim 16, wherein the liquid in the pressure chamber is circulated to the first surface side of the silicon substrate through the through hole disposed in the silicon substrate.

18. A method for manufacturing the liquid ejection head comprising a silicon substrate and an element disposed on the silicon substrate and configured to generate energy that is utilized for ejecting a liquid, the method comprising the steps of:

forming a protective layer A containing a metal oxide on the first surface of the silicon substrate by an atomic layer deposition (ALD) method;

forming an intermediate layer A containing a silicon compound on the protective layer A; and forming a structure containing an organic resin on the intermediate layer A.

19. A printing method comprising the step of ejecting a liquid containing a pigment from a liquid ejection head so as to perform printing, wherein the liquid ejecting head comprising:

a silicon substrate; and an element disposed on the silicon substrate and configured to generate energy that is utilized for ejecting a liquid, wherein a protective layer A containing a metal oxide is disposed on a first surface of the silicon substrate, wherein a structure containing an organic resin and constituting part of a liquid flow passage is disposed on the protective layer A, and wherein an intermediate layer A containing a silicon compound is disposed between the protective layer A and the structure.

* * * * *